US007725063B2

(12) United States Patent
Ueyama

(10) Patent No.: US 7,725,063 B2
(45) Date of Patent: May 25, 2010

(54) IMAGE-FORMING DEVICE WITH INTERLOCKINGLY MOVABLE TWO PAPER GUIDE MEMBERS

(75) Inventor: Junki Ueyama, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 351 days.

(21) Appl. No.: 11/937,084

(22) Filed: Nov. 8, 2007

(65) Prior Publication Data

US 2008/0290579 A1 Nov. 27, 2008

(30) Foreign Application Priority Data

Nov. 10, 2006 (JP) ..... 2006-305856

(51) Int. Cl.
*G03G 15/16* (2006.01)

(52) U.S. Cl. ..... 399/316; 399/317

(58) Field of Classification Search ..... 399/297, 399/310, 316, 317, 381, 388
See application file for complete search history.

(56) References Cited

U.S. PATENT DOCUMENTS 5,778,298 A * 7/1998 Enomoto et al. ..... 399/388
6,108,514 A * 8/2000 Nakayama et al. ..... 399/400
6,813,471 B2 * 11/2004 Sawai et al. ..... 399/388
7,539,446 B2 * 5/2009 Deguchi ..... 399/316
2001/0033760 A1 * 10/2001 Sawanaka et al. ..... 399/316

FOREIGN PATENT DOCUMENTS

JP 5-053449 A 3/1993

* cited by examiner

*Primary Examiner*—Hoan H Tran
(74) *Attorney, Agent, or Firm*—Banner & Witcoff, Ltd.

(57) ABSTRACT

An image-forming device includes a casing, a photosensitive drum, a transfer roller, a first guide member, and a second guide member. The first guide member is disposed upstream of the transfer point between the photosensitive drum and the transfer roller in a conveying direction of the recording medium and selectively movable between a first position and a second position. The second guide member is disposed between the first guide member and the transfer point and selectively movable between a third position and a fourth position farther from the photosensitive drum than the third position. The second guide member is movable in association with the movement of the first guide member in such a manner that when the first guide member is disposed in the first position, the second guide member is disposed in the third position for guiding the recording medium received from the first guide member to move toward the photosensitive drum.

22 Claims, 10 Drawing Sheets

IMAGE-FORMING DEVICE WITH INTERLOCKINGLY MOVABLE TWO PAPER GUIDE MEMBERS

CROSS REFERENCE TO RELATED APPLICATION

This application claims priority from Japanese Patent Application No. 2006-305856 filed Nov. 10, 2006. The entire content of this priority application is incorporated herein by reference.

TECHNICAL FIELD

The present invention relates to an image-forming device such as a laser printer, and a process cartridge mounted in the image-forming device.

BACKGROUND

Normally, a process cartridge is detachably mounted in image-forming devices such as laser printers. The process cartridge includes a photosensitive drum functioning to carry an electrostatic latent image, which is developed into a toner image by developer. The photosensitive drum is disposed in confrontation with and in contact with a transfer roller. The toner image carried on the photosensitive drum is transferred onto paper passing through a nip position between the photosensitive drum and the transfer roller by a transfer bias applied to the transfer roller. In this construction, a guide member is typically provided near the photosensitive drum upstream of the nip position in the paper-conveying direction for guiding the paper to the nip position.

Japanese unexamined patent application publication No. HEI-5-53449, for example, discloses a transfer unit provided with the following type of guide member. The guide member includes a paper conveying guide, an eccentric cam for pivoting the paper conveying guide, and a photosensor. When the photosensor detects the leading edge of the paper, the eccentric cam is rotated to place the paper conveying guide near the photosensitive drum. When the photosensor detects the trailing edge of the paper, the eccentric cam is rotated to separate the paper conveying guide from the photosensitive drum.

However, the transfer unit described in Japanese unexamined patent application publication No. HEI-5-53449 requires a photosensor and eccentric cam for placing the downstream portion of the guide member near to the photosensitive drum and separating the same portion from the photosensitive drum. Moreover, the transfer unit requires a motor for rotating the eccentric cam, and a control unit for driving the motor at a prescribed timing based on signals received from the photosensor, thereby requiring a larger number of parts and a more complex construction. This construction may also be less reliable because electronic units, such as the control circuit board on which the photosensor and control unit are provided, are susceptible to electrical malfunctions.

SUMMARY

Therefore, it is an object of the present invention to provide an image-forming device and a process cartridge having a simple construction for moving a guide portion of a guide member on the downstream side relative to the paper-conveying direction toward and away from a photosensitive member.

The above objects and others will be attained by an image-forming device that includes a casing, an image-carrying member, a transfer member, a first guide member, and a second guide member. The image-carrying member carries a developer image. The transfer member is disposed in confrontation with the image-carrying member and transfers the developer image from the image-carrying member to a recording medium at a transfer point of contact with the image-carrying member. The first guide member is disposed in a predetermined position upstream of the transfer point in a conveying direction of the recording medium. The first guide member is selectively movable between a first position and a second position. The second guide member disposed between the first guide member and the transfer point along the conveying direction of the recording medium. The second guide member is selectively movable between a third position and a fourth position farther from the image-carrying member than the third position. The second guide member is movable in association with the movement of the first guide member in such a manner that when the first guide member is disposed in the first position, the second guide member is disposed in the third position for guiding the recording medium received from the first guide member to move toward the image-carrying member.

When the image-carrying member is a photosensitive drum, this photosensitive drum may be provided in a process cartridge that is detachably mounted in the image-forming device. In this case, the second guide member may also be provided in the process cartridge.

By the second guide member moving in association with the first guide member, the image-forming device can guide recording medium toward the image-carrying member without a complex structure for guiding the recording medium toward the image-carrying member, such as a motor, a sensor for detecting the leading edge of paper, and CPU for moving the motor based on the signal from the sensor, and complex control. Therefore, it can reduce the number of required parts and simplify the construction.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
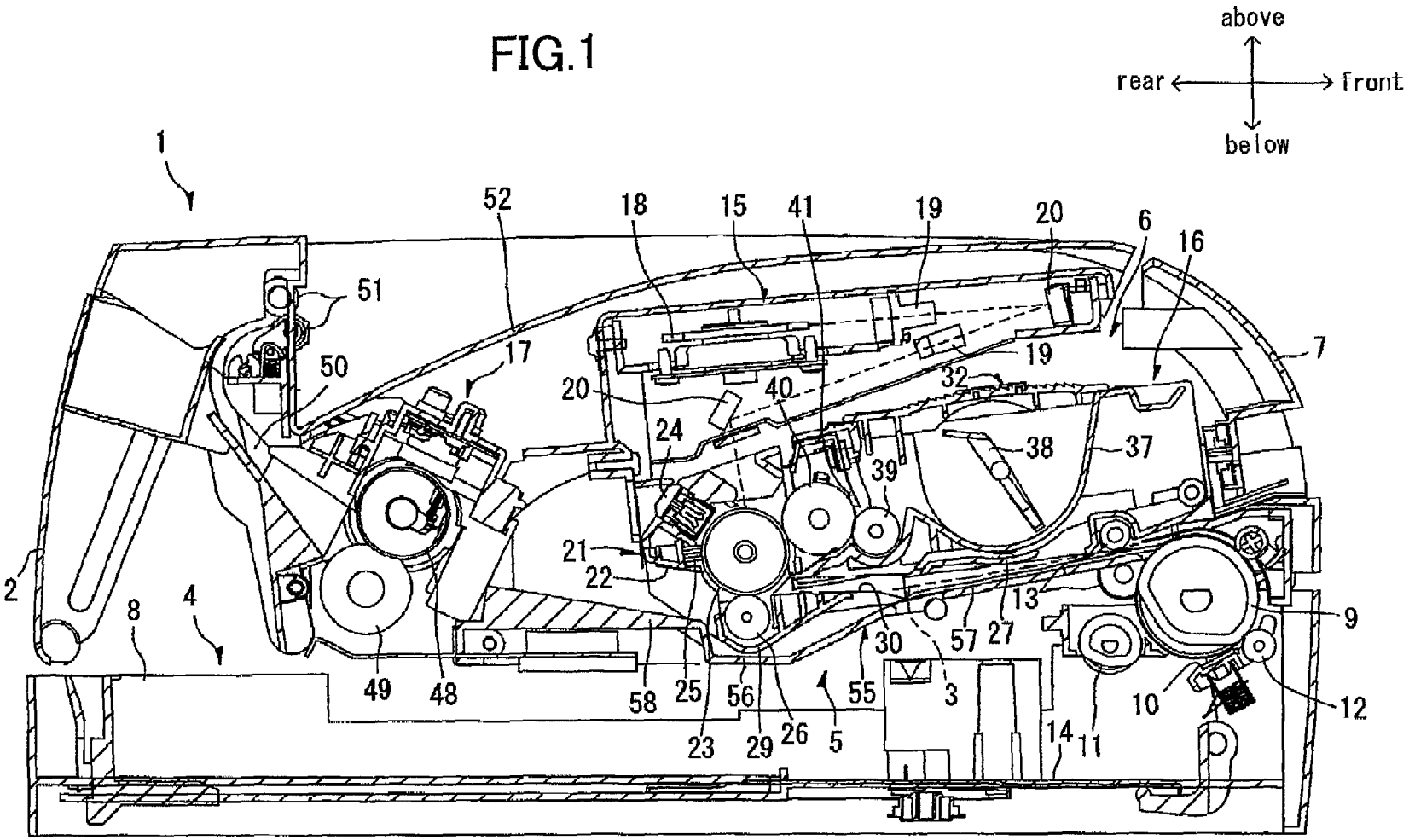
FIG. 1 is a side cross-sectional view showing a laser printer according to a preferred embodiment of the present invention.

An image-forming device according to preferred embodiments of the present invention will be described while referring to the accompanying drawings. FIG. 1 is a side cross-sectional view showing the relevant construction of a laser printer serving as a preferred embodiment of the image-forming device according to the present invention.

As shown in FIG. 1, a laser printer 1 includes a main casing 2, and, within the main casing 2, a feeder unit 4 for feeding a paper 3, an image-forming unit 5 for forming images on the paper 3 supplied from the feeder unit 4, and the like.

The laser printer 1 also includes an access opening 6 formed in one side wall of the main casing 2 for inserting and removing a process cartridge 16 described later, and a front cover 7 capable of opening and closing over the access opening 6. The front cover 7 is rotatably supported by a cover shaft (not shown) inserted through a bottom end of the front cover 7. Accordingly, when the front cover 7 is rotated closed about the cover shaft, the front cover 7 covers the access opening 6. When the cover is rotated open about the cover shaft, the access opening 6 is exposed, enabling the process cartridge 16 to be mounted into or removed from the main casing 2 via the access opening 6. A control panel (not shown), including operating keys and an LED display unit, is embedded in the front cover 7.

Hereinafter, the side of the laser printer 1 and the process cartridge 16 on which the front cover 7 is provided will be referred to as the "front side" and the opposite side as the "rear side". The side of the laser printer 1 and the process cartridge 16 on which the feeder unit 4 is provided will be referred to as the "below side" and the opposite side as the "above side".

The feeder unit 4 includes a paper supply tray 8 that is detachably mounted in a lower section of the main casing 2, a feeding roller 9 and separating pad 10 disposed above the front end of the paper supply tray 8, a pickup roller 11 disposed on the rear side of the feeding roller 9, a pinch roller 12 disposed in opposition to the feeding roller 9 on the lower front side thereof, and a pair of registration rollers 13 disposed on the above rear side of the feeding roller 9.

A paper pressing plate 14 is provided inside the paper supply tray 8 for supporting the paper 3 in a stacked state. The paper pressing plate 14 is pivotably supported on the rear end thereof, so that the front end can move vertically. When the front end of the paper pressing plate 14 is lifted, the topmost sheet of the paper 3 stacked on the paper pressing plate 14 is pressed against the pickup roller 11. The pickup roller 11 rotates to begin conveying the topmost sheet of the paper 3 between the feeding roller 9 and separating pad 10. The registration rollers 13 convey the sheet of the paper 3 to a transfer point in the image-forming unit 5. The transfer point is a position between a photosensitive drum 23 and a transfer roller 26. The photosensitive drum 23 and the transfer roller 26 are described later.

A paper-guiding plate 55 is provided in the main casing 2 along a conveying path of the paper 3 extends from the registration rollers 13, through the image-forming unit 5, to a fixing unit 17 described later. The paper-guiding plate 55 is formed in a flat plate-shape and disposed above the paper tray 8.

The paper-guiding plate 55 is configured of a recessed part 56, a front guiding plate 57, and a rear guiding plate 58. The recessed part 56 is formed in a center portion of the paper-guiding plate 55 relative to the front-to-rear direction. The front guiding plate 57 extends from the front end of the paper-guiding plate 55 to the recessed part 56 for conveying the paper 3 from the registration rollers 13 to the transfer point. The front guiding plate 57 slopes downward toward the rear side. A device-side slit 59 (see FIG. 7) is formed in a left-to-right center of the front guiding plate 57. The side of the laser printer 1 and the process cartridge 16 on which a photosensor 75 (as described later) is provided will be referred to as the "left side", and the opposite side as the "right side" in FIG. 5. The device-side slit 59 is substantially rectangular in shape and extends in the front-to-rear direction into the recessed part 56.

The rear guiding plate 58 extends from the recessed part 56 to the rear edge of the paper-guiding plate 55 for conveying the paper 3 from the transfer point to the fixing unit 17. The rear guiding plate 58 slopes upward toward the rear side.

The image-forming unit 5 includes a scanning unit 15, the process cartridge 16, the fixing unit 17, and the like.

The scanning unit 15 is disposed in the top section of the main casing 2 and includes a laser light source (not shown), a polygon mirror 18 that can be driven to rotate, fθ lenses 19, reflecting mirrors 20, and the like. The laser light source emits a laser beam based on image data. As illustrated by a dotted line in FIG. 1, the laser beam is deflected by the polygon mirror 18, passes through the fθ lens 19, and is reflected rearward by the reflecting mirror 20. After passing through the fθ lenses 19, the laser beam is reflected downward by the reflecting mirrors 20 and irradiated on the surface of the photosensitive drum 23 described later in the process cartridge 16.

The process cartridge 16 is detachably mounted in the main casing 2 below the scanning unit 15.

Figure 2:
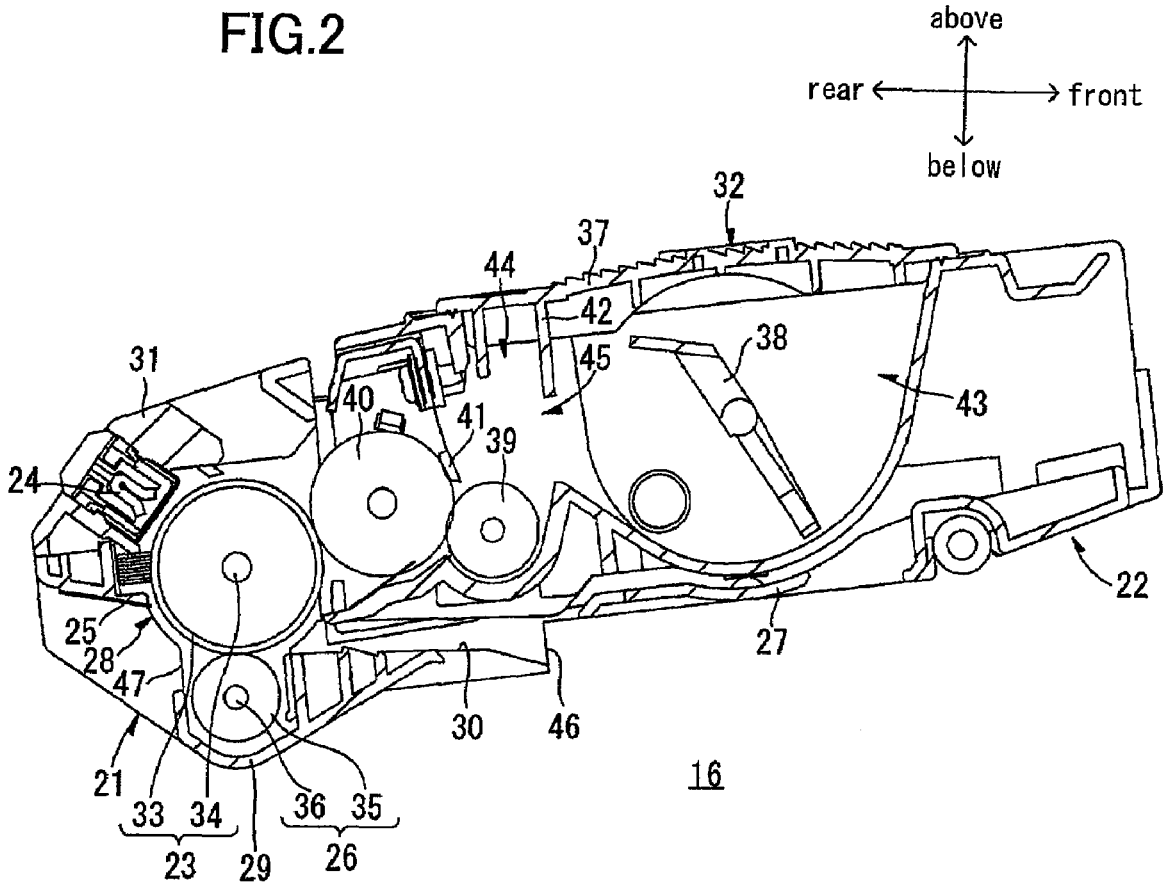
FIG. 2 is a side cross-sectional view of a process cartridge that detachably mounts in the laser printer.

FIG. 2 is a cross-sectional side view of the process cartridge 16. As shown in FIG. 2, the process cartridge 16 includes a drum cartridge 21, and a developer cartridge 32 that is detachably mounted on the drum cartridge 21. The drum cartridge 21 includes a drum frame 22, a photosensitive drum 23, a scorotron charger 24, a cleaning brush 25, and a transfer roller 26.

Figure 5:
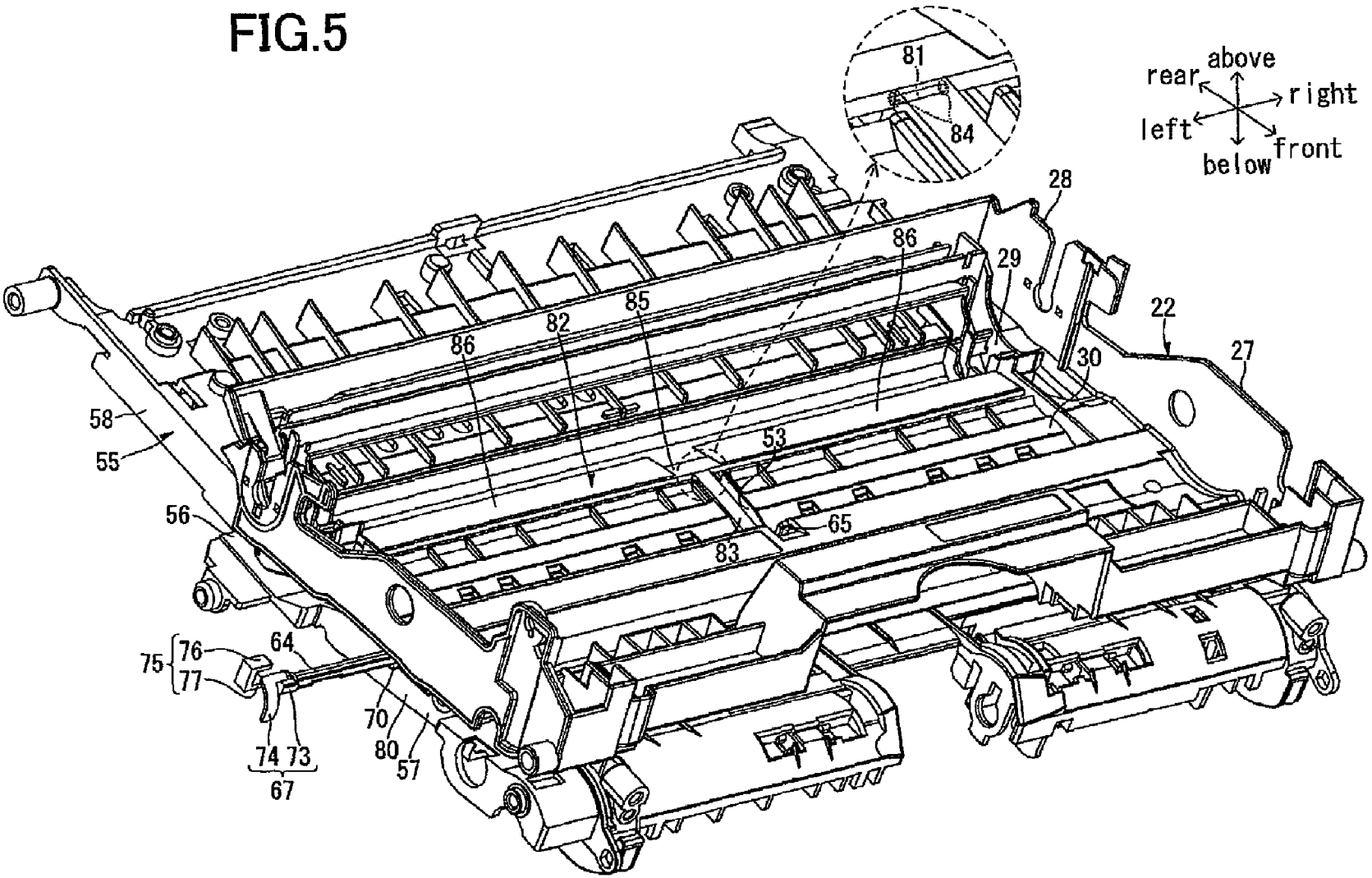
FIG. 5 is a perspective view from the plan view side of the paper-guiding plate (not during the transfer operation)

As shown in FIG. 5, the drum frame 22 extends in the front-to-rear direction and is partitioned into a front part and a rear part. The front part is a developer-cartridge-accommodating section 27 for accommodating the developer cartridge 32 (see FIG. 2), while the rear part is a photosensitive-drum-accommodating section 28 for accommodating the photosensitive drum 23 (see FIG. 2). A transfer-roller-accommodating section 29 is provided in the drum frame 22 below the photosensitive-drum-accommodating section 28 for accommodating the transfer roller 26 (see FIG. 2).

As shown in FIG. 2, a charger-supporting section 31 is provided in the drum frame 22 above the rear side of the photosensitive-drum-accommodating section 28 for supporting the scorotron charger 24. A plate-shaped chute 30 is also provided in the drum frame 22 for guiding the paper 3 to the transfer point.

The chute 30 forms the bottom wall on the rear part of the developer-cartridge-accommodating section 27. The chute 30 is separated a prescribed distance from the front end of the transfer-roller-accommodating section 29 and slopes downward toward the front. The chute 30 is formed a step lower than the bottom wall on the front part of the developer-cartridge-accommodating section 27. A paper inlet 46 is formed between the front end of the chute 30 and the bottom wall on the front part of the developer-cartridge-accommodating section 27 for introducing the paper 3 into the drum cartridge 21.

Figure 7:
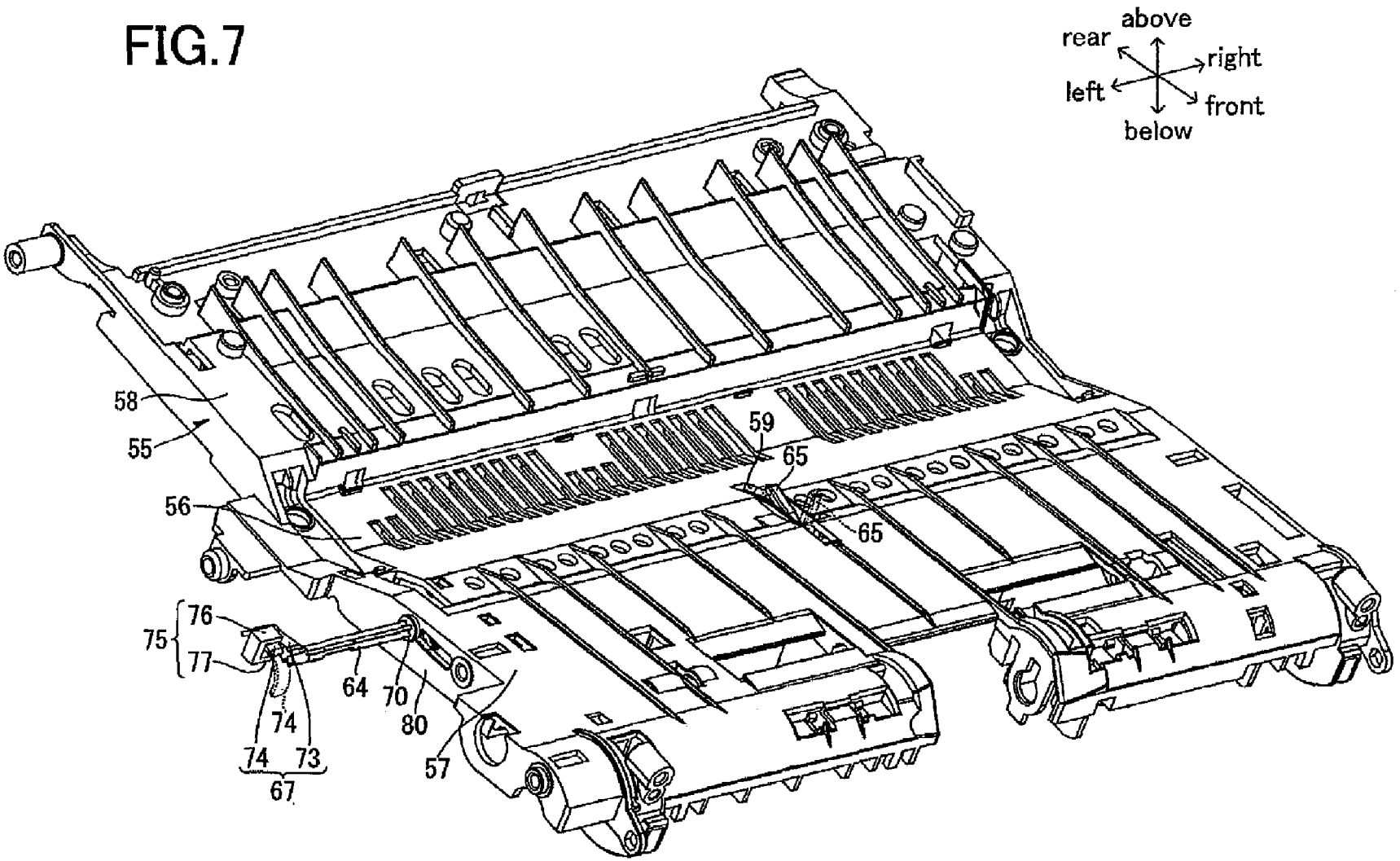
FIG. 7 is a perspective view from the plan view side of the paper-guiding plate (during the transfer operation)

As shown in FIG. 5, a drum-side slit 53 is formed in a portion of the chute 30 opposing the device-side slit 59 (see FIG. 7). The drum-side slit 53 is substantially rectangular in shape and disposed in the left-to-right center (widthwise center) of the chute 30.

As shown in FIG. 2, a paper outlet 47 is formed in the rear end of the transfer-roller-accommodating section 29 for guiding the paper 3 out of the drum cartridge 21.

When the drum frame 22 is mounted in the main casing 2, as shown in FIG. 1, the transfer-roller-accommodating section 29 and chute 30 are accommodated in the recessed part 56 of the paper-guiding plate 55. At this time, the front part of the bottom wall of the developer-cartridge-accommodating section 27 opposes the front guiding plate 57 of the paper-guiding plate 55 and is separated slightly therefrom in the vertical direction.

As shown in FIG. 2, the photosensitive drum 23 is accommodated in the photosensitive-drum-accommodating section 28. The photosensitive drum 23 includes a main drum body 33 that is cylindrical in shape and has a positively charged photosensitive layer on its outer surface, and a metal drum shaft 34 extending along the axial center of the main drum body 33 in the longitudinal direction thereof. The drum shaft 34 can be rotatably supported in both side plates of photosensitive-drum-accommodating section 28, while the main drum body 33 is rotatably supported on the drum shaft 34.

The scorotron charger 24 is mounted on the charger-mounting unit 31 diagonally above and rearward of the photosensitive drum 23. The scorotron charger 24 is disposed in opposition to but separated a prescribed distance from the photosensitive drum 23 so as not to contact the same. The scorotron charger 24 is a positively charging scorotron charger that generates a corona discharge from a wire formed of tungsten or the like, and can form a uniform charge of positive polarity over the surface of the photosensitive drum 23.

The cleaning brush 25 is mounted on the rear side of the photosensitive drum 23. The cleaning brush 25 is disposed so that a tip of the cleaning brush 25 is in contact with the surface of the main drum body 33 of the photosensitive drum 23.

The transfer roller 26 is rotatably supported on both side plates of the drum cartridge 21 and contacts the photosensitive drum 23 in the above-to-below direction from the bottom thereof. The transfer roller 26 is configured of a metal roller shaft 36 that is covered with a roller 35 formed of a conductive rubber material. During a transfer operation, a transfer bias is applied to the transfer roller 26.

When the laser printer 1 is printing, the drive force from a motor (not shown) is transmitted to the roller shaft 36 for driving the transfer roller 26 to rotate together with the roller shaft 36.

The developer cartridge 32 is formed in a box shape that is open on the rear side. Within the developer cartridge 32 are provided a developer frame 37, an agitator 38 accommodated in the developer frame 37, a supply roller 39, a developing roller 40, and a layer-thickness regulating blade 41.

The developer frame 37 is formed in a box shape open on the rear side. A partition 42 is provided for partitioning the developer frame 37 into a toner-accommodating chamber 43 on the front side, and a developing chamber 44 on the rear side. A passage 45 is formed in the partition 42 for providing communication between the toner-accommodating chamber 43 and developing chamber 44. The toner-accommodating chamber 43 accommodates toner.

The agitator 38 is provided in the toner-accommodating chamber 43. The supply roller 39 is disposed rearward of the passage 45 in the developing chamber 44. The developing roller 40 is disposed rearward of the supply roller 39 in the developing chamber 44 and contacts the supply roller 39 so that both are compressed by the force.

The layer-thickness regulating blade 41 is provided above the developing roller 40 in the developing chamber 44 and contacts the surface of the developing roller 40 with pressure.

With this construction, the agitator 38 stirs toner in the toner accommodating chamber 43, discharging toner toward the developing chamber 44. Discharged toner is supplied onto the developing roller 40 by the rotating supply roller 39. At this time, the toner is positively tribocharged between the supply roller 39 and developing roller 40. As the developing roller 40 rotates, toner supplied to the surface of the developing roller 40 passes between the developing roller 40 and the layer-thickness regulating blade 41, thereby maintaining a uniform thickness of toner layer on the surface of the developing roller 40.

As the photosensitive drum 23 rotates, the scorotron charger 24 charges the surface of the photosensitive drum 23 with a uniform positive polarity. Subsequently, a laser beam emitted from the scanning unit 19 (see FIG. 1) is scanned at a high speed over the surface of the photosensitive drum 23, forming an electrostatic latent image corresponding to an image that will be formed on the paper 3.

Next, positively charged toner carried on the surface of the developing roller 40 comes into contact with the photosensitive drum 23 as the developing roller 40 rotates and is supplied to areas on the surface of the positively charged photosensitive drum 23 that were exposed to the laser beam and, therefore, have a lower potential. In this way, the latent images on the photosensitive drum 23 are transformed into visible images so that a reverse toner image is carried on the surface of the photosensitive drum 23.

As shown in FIG. 1, when the registration rollers 13 convey the paper 3 to a transfer point between the photosensitive drum 23 and transfer roller 26, the toner image carried on the surface of the photosensitive drum 23 is transferred onto the paper 3 by a transfer bias applied to the transfer roller 26. After the toner image is transferred, the paper 3 is conveyed to the fixing unit 17. Toner remaining on the photosensitive drum 23 after the transfer operation is recovered by the developing roller 40. Further, paper dust deposited on the photosensitive drum 23 from the paper 3 is recovered by the cleaning brush 25 after the transfer operation.

The fixing unit 17 is disposed on the rear side of the process cartridge 16 and includes a heating roller 48 and a pressure roller 49. The pressure roller 49 is disposed below and contacts the heating roller 48 with pressure.

In the fixing unit 17, toner transferred onto the paper 3 at the transfer point is fixed to the paper 3 by heat as the paper 3 passes between the heating roller 48 and pressure roller 49. After the fixing process, the paper 3 is conveyed along a discharge path 50 that leads up to the top surface of the main casing 2. Discharge rollers 51 provided at the top of the discharge path 50 discharge the paper 3 onto a discharge tray 52 formed on the top surface of the main casing 2.

Figure 3:
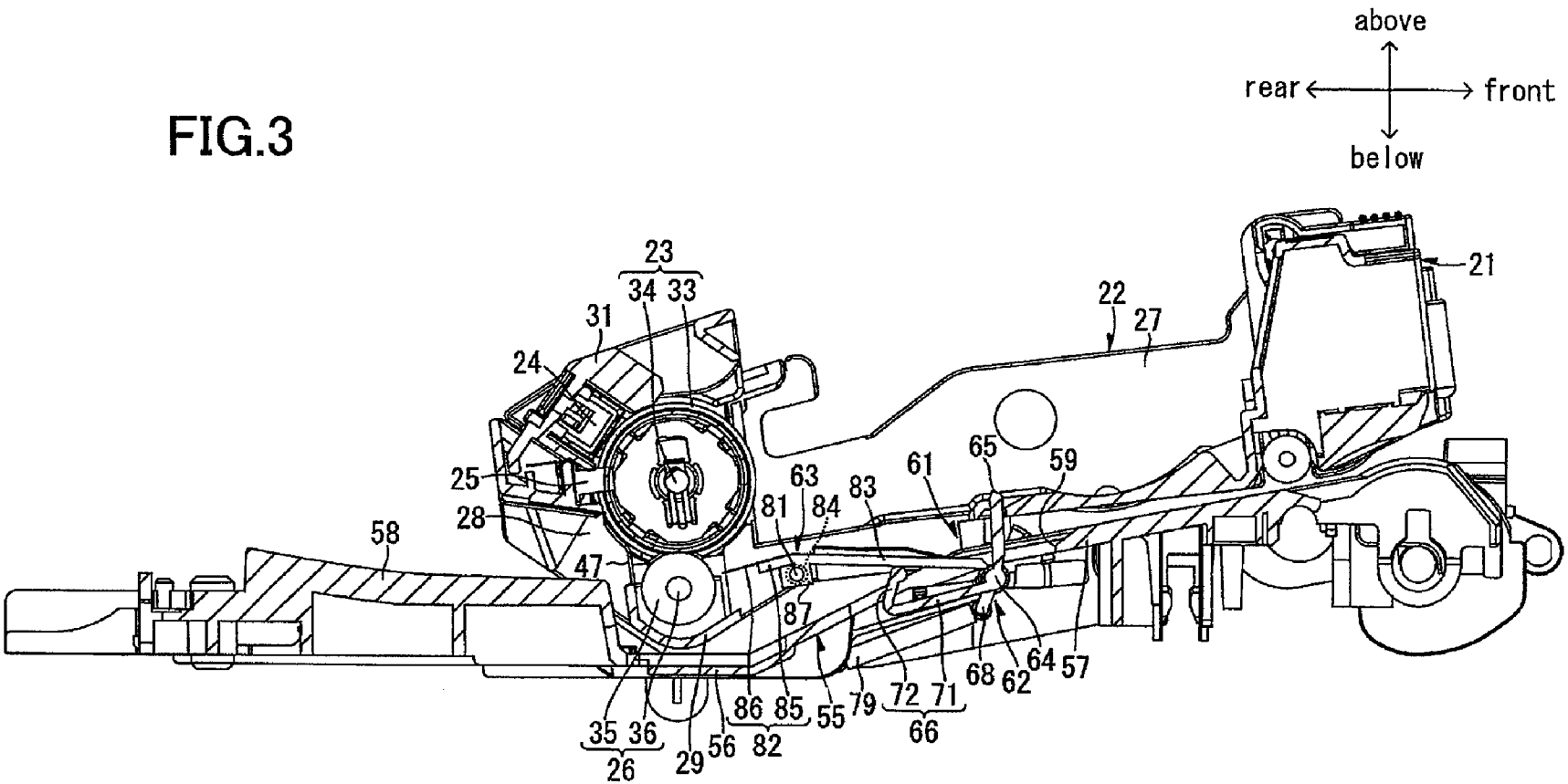
FIG. 3 is a side cross-sectional view of a drum cartridge and a paper-guiding plate (not during the transfer operation)

Next, a transfer position guiding mechanism 61 (see FIG. 9) for guiding the paper 3 to the transfer point will be described with reference to FIGS. 3 through 10. As shown in FIG. 3, the transfer position guiding mechanism 61 includes a first pivoting member 62 and a second pivoting member 63.

The first pivoting member 62 is disposed in a predetermined position upstream (on the front side) of the transfer point. The first pivoting member 62 pivotably is supported on the paper-guiding plate 55 of the main casing 2. In other words, the first pivoting member 62 is selectively movable between a non-passing position and a passing position. The non-passing position and passing position are described later. The first pivoting member 62 functions to guide the paper 3 toward the second pivoting member 63.

The first pivoting member 62 is integrally configured of a first rotational shaft 64, a paper contact part 65, a first contact part 66, a sensor arm 67 (see FIG. 5), and a pivot-restricting protrusion 68.

Figure 8:
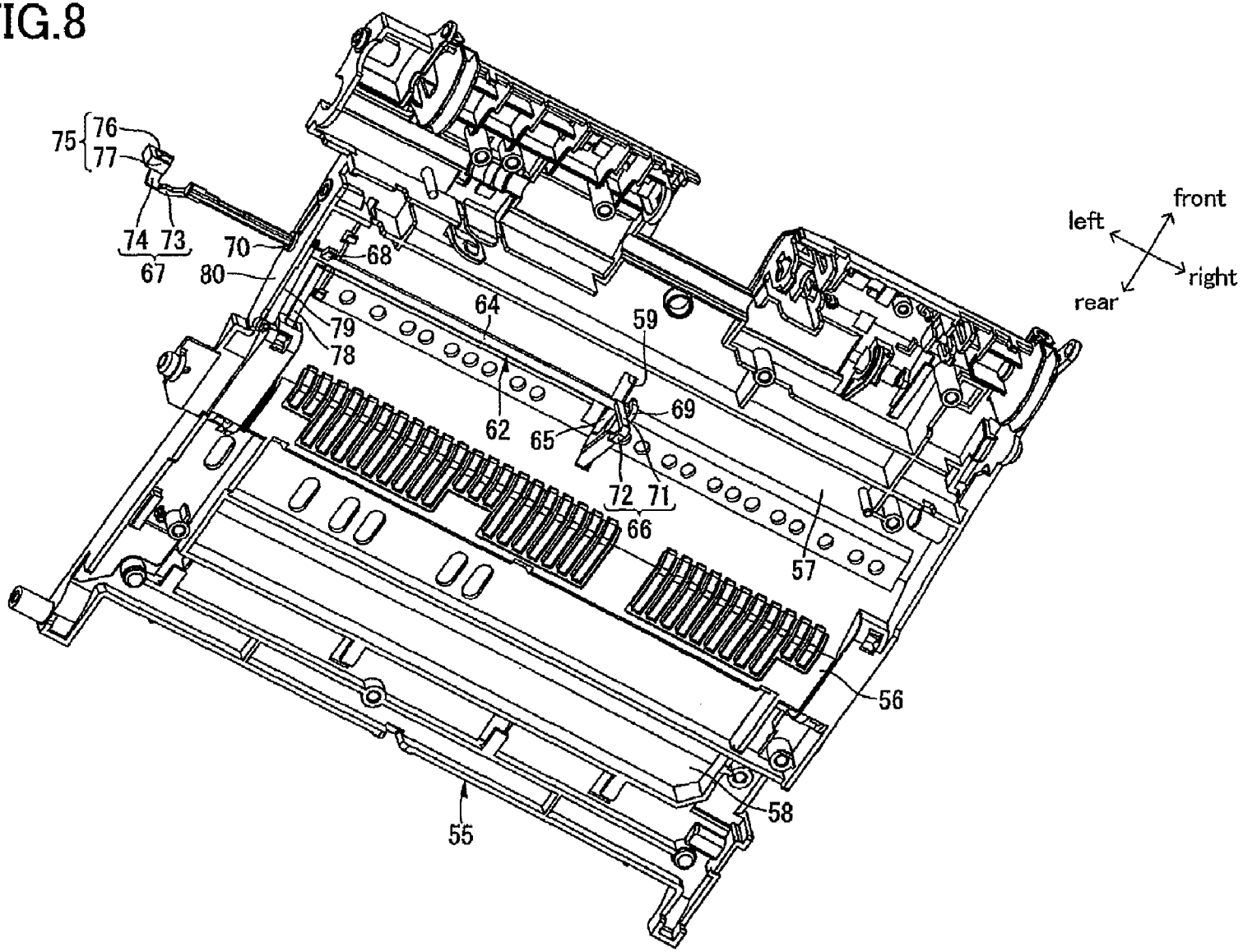
FIG. 8 is a perspective view from the bottom side of the paper-guiding plate (during the transfer operation)

FIG. 8 is a perspective view from the bottom side of the paper-guiding plate (during the transfer operation). As shown in FIG. 8, the first rotational shaft 64 extends in the left-to-right direction below the front guiding plate 57. More specifically, a right bearing part 69 is provided on the bottom surface of the paper-guiding plate 55 in a left-to-right center region thereof, on the right side of the device-side slit 59. A side plate 80 is provided on the left end of the paper-guiding plate 55 extending downward. A left bearing part 70 is provided on the side plate 80 at a position along a plane passing through the right bearing part 69 in the left-to-right direction.

The first rotational shaft 64 is inserted into and rotatably supported by the right bearing part 69 and left bearing part 70. More specifically, the first rotational shaft 64 is supported in the right bearing part 69 and left bearing part 70 with a midpoint of the first rotational shaft 64 in the left bearing part 70 and the left end of the first rotational shaft 64 protruding leftward from the left bearing part 70. Thereby, the first rotational shaft 64 can rotate about an axial center of the first rotational shaft 64. The first rotational shaft 64 is also disposed to intersect the device-side slit 59 in the left-to-right direction.

As shown in FIG. 3, the paper contact part 65 protrudes radially outward from the first rotational shaft 64. The paper contact part 65 is formed of a slender plate piece slightly narrower than the device-side slit 59 and is disposed opposite the device-side slit 59. The paper contact part 65 is configured to protrude through the device-side slit 59 farther than the top surface of the front guiding plate 57.

Figure 9:
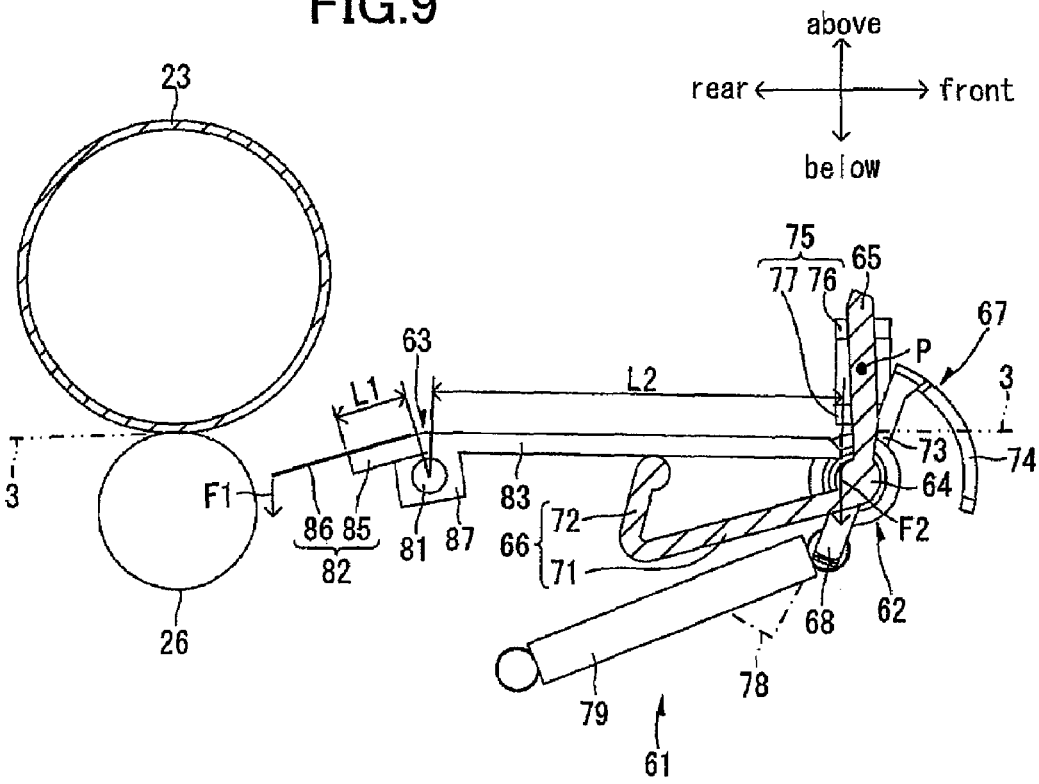
FIG. 9 is a side view illustrating a transfer point guiding mechanism (not during the transfer operation)

FIG. 9 is a side view of the transfer position guiding mechanism 61. As shown in FIGS. 3 and 9, the first contact part 66 protrudes radially outward from the first rotational shaft 64 in a different direction from the paper contact part 65 and, more specifically, forms an obtuse angle (100-130°, for example) with the paper contact part 65. The first contact part 66 is formed of a slender plate piece having substantially the same width as the paper contact part 65, and is also disposed in a position on the first rotational shaft 64 corresponding to the device-side slit 59, i.e. the same left-to-right position as the paper contact part 65.

As shown in FIGS. 8 and 9, the first contact part 66 is formed substantially in the shape of the letter J in a side view. More specifically, the first contact part 66 includes a protruding rod 71 that protrudes radially outward from the first rotational shaft 64, and an engaging piece 72 that protrudes further from the protruding portion. The engaging piece 72 bents from the free end of the protruding rod 71 toward a second contact part 83 described later at an acute angle (30-60°, for example). The engaging piece 72 is shorter than the protruding rod 71, and the distal end of the engaging piece 72 is rounded into a circular shape when viewed from the side.

As shown in FIGS. 8 and 9, the sensor arm 67 is formed substantially in an L-shape having an arm part 73 disposed on the left end of the first rotational shaft 64, and a light-interrupting piece 74 provided on the distal end of the arm part 73.

The arm part 73 protrudes radially outward from the left end of the first rotational shaft 64 in a different direction from the paper contact part 65 when viewed from the side, and more specifically forms an acute angle (5-45°, for example) with the paper contact part 65.

As shown in FIGS. 5 and 9, the light-interrupting piece 74 projects slightly leftward from the distal end of the arm part 73, then extends from the left end of the projected part in a circumferential direction around the first rotational shaft 64, forming an arc shape that is curved in the front-to-rear direction. As shown in FIGS. 5, 6, 9 and 10, the light-interrupting piece 74 pivots in the circumferential direction about the center of the first rotational shaft 64 when the first rotational shaft 64 rotates.

Figure 6:
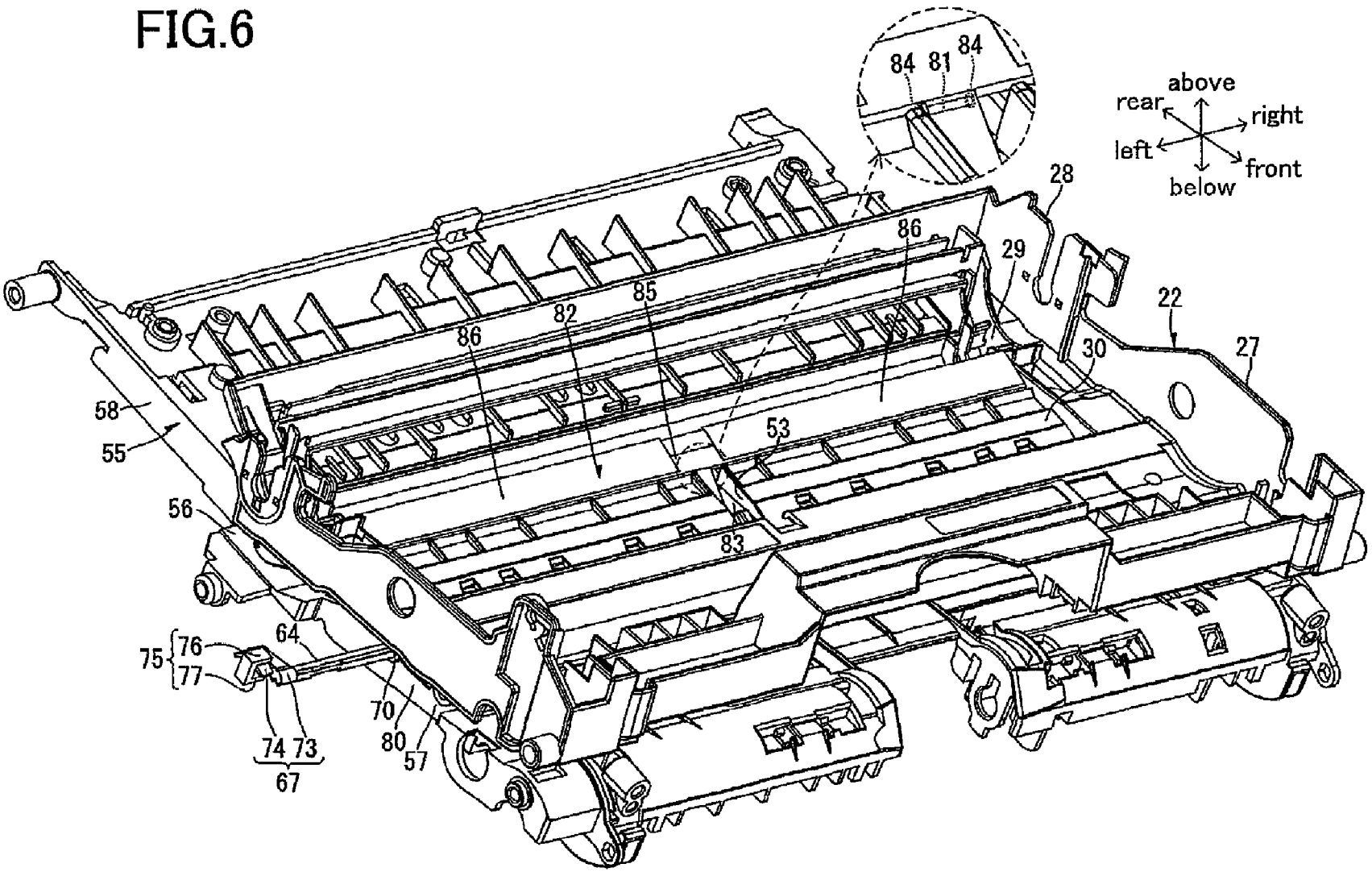
FIG. 6 is a perspective view from the plan view side of the paper-guiding plate (during the transfer operation)

The photosensor 75 is also provided in the main casing 2. As shown in FIGS. 5 and 6, the photosensor 75 is disposed in the same position as the light-interrupting piece 74 relative to the left-to-right direction and is positioned in the front-to-rear direction for allowing the light-interrupting piece 74 to be interposed therein and retracted therefrom as the first rotational shaft 64 rotates. The photosensor 75 is shaped substantially like three sides of a rectangle and includes a light-emitting element 76 and a light-receiving element 77 that are separated but confront each other vertically. A detection position P shown in FIGS. 9 and 10 is a position at which the photosensor 75 detects a detection light transmitted between the light-emitting element 76 and light-receiving element 77.

Figure 10:
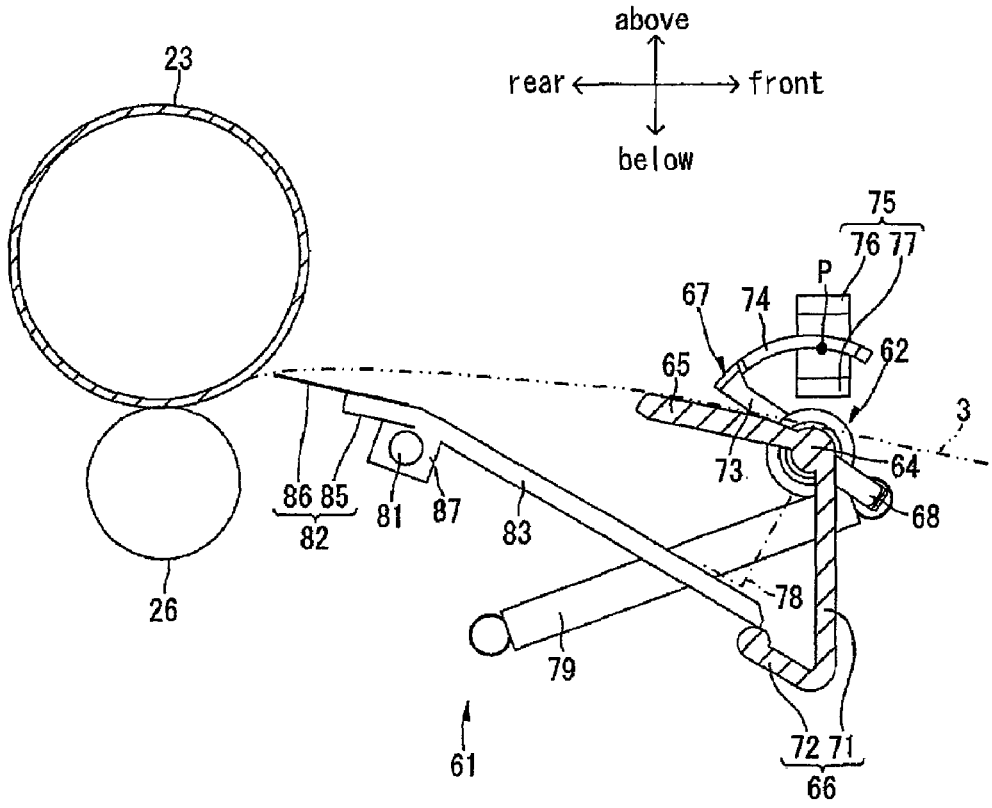
FIG. 10 is a side view illustrating the transfer point guiding mechanism (during the transfer operation)

Through rotation of the first rotational shaft 64, the light-interrupting piece 74 pivots between a retracted position shown in FIGS. 5 and 9, when the light-interrupting piece 74 is retracted from the light-emitting element 76 and light-receiving element 77, and an advanced position shown in FIGS. 6 and 10, when the light-interrupting piece 74 is interposed between the light-emitting element 76 and light-receiving element 77.

When the light-interrupting piece 74 is in the retracted position shown in FIGS. 5 and 9, the light-interrupting piece 74 is separated from the detection position P, allowing the light-receiving element 77 to receive detection light emitted from the light-emitting element 76.

When the light-interrupting piece 74 is in the advanced position shown in FIGS. 6 and 10, the light-interrupting piece 74 overlaps the detection position P, thereby blocking the detection light emitted from the light-emitting element 76 and preventing the light-receiving element 77 from receiving this detection light.

As shown in FIG. 8, the pivot-restricting protrusion 68 has a substantially rectangular plate shape and is provided near the right side of the left bearing part 70. As shown in FIGS. 9 and 10, the pivot-restricting protrusion 68 protrudes radially outward from the first rotational shaft 64 in a different direction than the paper contact part 65, and more specifically in a direction forming an obtuse angle (120-180°, for example) with the paper contact part 65.

As shown in FIG. 8, a stopper 78 is provided on the bottom surface of the paper-guiding plate 55 near the right side of the left bearing part 70 so as to be capable of contacting the pivot-restricting protrusion 68. The stopper 78 is substantially rectangular in shape and extends in the front-to-rear direction. As shown in FIG. 9, the stopper 78 is disposed on the bottom surface of the paper-guiding plate 55 at an angle for contacting the pivot-restricting protrusion 68 when the first rotational shaft 64 rotates so that the paper contact part 65 is erected vertically. Hereafter, the first pivoting member 62 is said to be in a "non-passing position" when the paper contact part 65 is erected vertically.

As shown in FIGS. 8 and 10, a spring 79 is also connected to the first pivoting member 62 for positioning the first pivoting member 62 in the non-passing position. More specifically, the spring 79 urges the pivot-restricting protrusion 68 so that the first pivoting member 62 moves from the passing position toward the non-passing position. The spring 79 is configured of a coil spring (tension spring) and extends in the front-to-rear direction between the side plate 80 (see FIG. 8) on the left end of the paper-guiding plate 55 and the stopper 78. One end of the spring 79 is engaged in a spring-engaging part (not shown) protruding from the first rotational shaft 64 in substantially the same radially direction as the pivot-restricting protrusion 68, while the other end is engaged with the side plate 80.

The urging force of the spring 79 urges the first pivoting member 62 in a direction for rotating the first rotational shaft 64 clockwise in FIG. 9. Hence, when no external forces are applied, the first rotational shaft 64 rotates clockwise until the pivot-restricting protrusion 68 contacts the stopper 78, placing the first pivoting member 62 in the non-passing position. By contacting the stopper 78, the pivot-restricting protrusion 68 restricts the first rotational shaft 64 from rotating past the non-passing position in the clockwise direction. In other words, the first pivoting member 62 can pivot from the passing position to the non-passing position in the clockwise direction without overrunning the non-passing position.

When the first pivoting member 62 is disposed in the non-passing position, the paper contact part 65 is in the erect state shown in FIGS. 3 and 5, protruding upward from the front guiding plate 57 through the device-side slit 59, and is received in the drum-side slit 53 on the drum side (see FIG. 5). Further, the first contact part 66 is arranged so that the protruding rod 71 extends rearward, while the sensor arm 67 is arranged with the light-interrupting piece 74 in the retracted position shown in FIG. 9.

As shown in FIG. 3, the second pivoting member 63 is disposed between the first pivoting member 62 and the transfer point along the conveying direction of paper 3 (front-to-rear direction). The second pivoting member 63 guides a sheet of paper 3 received from the first pivoting member 62 to the photosensitive drum 23. The second pivoting member 63 is pivotably supported by the chute 30 of the process cartridge 16 (see FIG. 2). More specifically, the second pivoting member 63 is selectively movable between a separated position and a proximal position. The separated position is farther from the photosensitive drum 23 than the proximal position, described later.

As shown in FIGS. 3 and 5, the second pivoting member 63 is integrally configured of a second rotational shaft 81, a transfer guide part 82, and the second contact part 83.

As shown in FIG. 3, the transfer guide part 82 and second contact part 83 form an inverted V-shape over the second rotational shaft 81. The transfer guide part 82 and the second contact part 83 protrude forward from the second rotational shaft 81.

Shaft-supporting parts 84 are provided on the rear end of the chute 30 for rotatably supporting the second rotational shaft 81. As shown in FIG. 5, the second rotational shaft 81 is formed slightly longer than the drum-side slit 53 in the left-to-right direction. The second rotational shaft 81 is inserted through the shaft-supporting parts 84 and rotates about its axial center, serving as a second support point.

The shaft-supporting parts 84 are formed in the left-to-right center of the chute 30 on the rear end of the drum-side slit 53 so that the drum-side slit 53 is interposed between the shaft-supporting parts 84 in the left-to-right direction.

As shown in FIGS. 5 and 9, the transfer guide part 82 includes a guide-supporting part 85 protruding from the second rotational shaft 81 toward the transfer point, and film members 86 extending from the rear edge of the guide-supporting part 85 toward the transfer point.

As shown in FIG. 9, the guide-supporting part 85 is formed in a flat plate-shape extending in the left-to-right direction and is disposed on the rear side of the chute 30 (see FIG. 5). The center of the front edge on the guide-supporting part 85 is fixed to the second rotational shaft 81 via a mounting plate 87. The rear edge of the guide-supporting part 85 extends to a point between the second rotational shaft 81 and photosensitive drum 23 and confronts the photosensitive drum 23 with a gap formed therebetween.

As shown in FIG. 5, two of the film members 86 are disposed adjacent to each other in the left-to-right direction with a gap formed therebetween in the left-to-right center of the guide-supporting part 85. The film members 86 are flexible film formed of a synthetic resin or the like in a substantially rectangular shape. The film members 86 are affixed to the top surface of the guide-supporting part 85, extending in the left-to-right direction along the rear edge thereof. The rear edges of the film members 86 extend from the guide-supporting part 85 of the second pivoting member 63.

As shown in FIG. 5, the second contact part 83 is formed in a substantially rectangular shape slightly narrower than the drum-side slit 53, and extends in the front-to-rear direction. The second contact part 83 is disposed inside the drum-side slit 53, with the rear end of the second contact part 83 affixed to the second rotational shaft 81 via the mounting plate 87 (see FIG. 9). As shown in FIG. 9, the second contact part 83 protrudes from the second rotational shaft 81 toward the first contact part 66 of the first pivoting member 62 such that the distal end of the second contact part 83 can contact the engaging piece 72 from above.

The second pivoting member 63 is formed to satisfy the equation $L1 \cdot F1 < L2 \cdot F2$, where L1 is the distance from the second rotational shaft 81 to the rear end of the guide-supporting part 85, F1 is the force that the weight of the transfer guide part 82 generates at the rear end of the guide-supporting part 85, L2 is the distance from the second rotational shaft 81 to the front end of the second contact part 83, and F2 is the force that the weight of the second contact part 83 generates at the front edge of the second contact part 83.

Hence, the second pivoting member 63 is urged by its own weight to pivot so that the transfer guide part 82 pivots upward and the second contact part 83 pivots downward. Specifically, the second pivoting member 63 is urged to rotate clockwise in FIG. 9 about the second rotational shaft 81. Thereby, the second contact part 83 is moved in interlocking relation with the engaging piece 72 of first contact part 66.

However, since the first pivoting member 62 is disposed in the non-passing position shown in FIG. 9 by the urging force of the spring 79, as described above, the first contact part 66 is oriented with the protruding rod 71 extending rearward and the engaging piece 72 protruding upward.

Accordingly, the second pivoting member 63 is disposed in the separated position when the first pivoting member 62 is disposed in the non-passing position. The separated position is the state of the second pivoting member 63 when the film members 86 are separated from the photosensitive drum 23. In other words, the film members 86 are oriented farther from the photosensitive drum 23 when the second pivoting member 63 is moved to the non-passing position. When the second pivoting member 63 is in the separated position, the transfer guide part 82 protrudes rearward and slightly downward from the second rotational shaft 81. At this time, the rear edges of the film members 86 are positioned toward the transfer roller 26 and separated from the photosensitive drum 23. Further, the second contact part 83 protrudes forward from the second rotational shaft 81, and the front-to-rear center portion of the second contact part 83 contacts the top of the engaging piece 72.

As described above, the first pivoting member 62 is in the non-passing position and the second pivoting member 63 is in the separated position when the paper 3 is not passing over the first pivoting member 62. When the paper 3 is conveyed from the registration rollers 13 so that the leading edge of the paper 3 in the conveying direction (hereinafter simply referred to as "leading edge") contacts the paper contact part 65 positioned in the conveying path, as shown in FIG. 9, the pressure applied to the paper contact part 65 by the paper 3 causes the paper contact part 65 to rotate rearward, and the first rotational shaft 64 rotates counterclockwise against the urging force of the spring 79.

When the paper contact part 65 rotates rearward about the center of the first rotational shaft 64, as shown in FIG. 10, the paper 3 is conveyed over the paper contact part 65 toward the photosensitive drum 23. In other words, abutting the paper 3 conveyed against the paper contact part 65 rotates the paper contact part 65 to move the first pivoting member 62 to the passing position from the non-passing position. The passing position is the orientation of the first pivoting member 62 when the paper contact part 65 is laid downward toward the rear.

Figure 4:
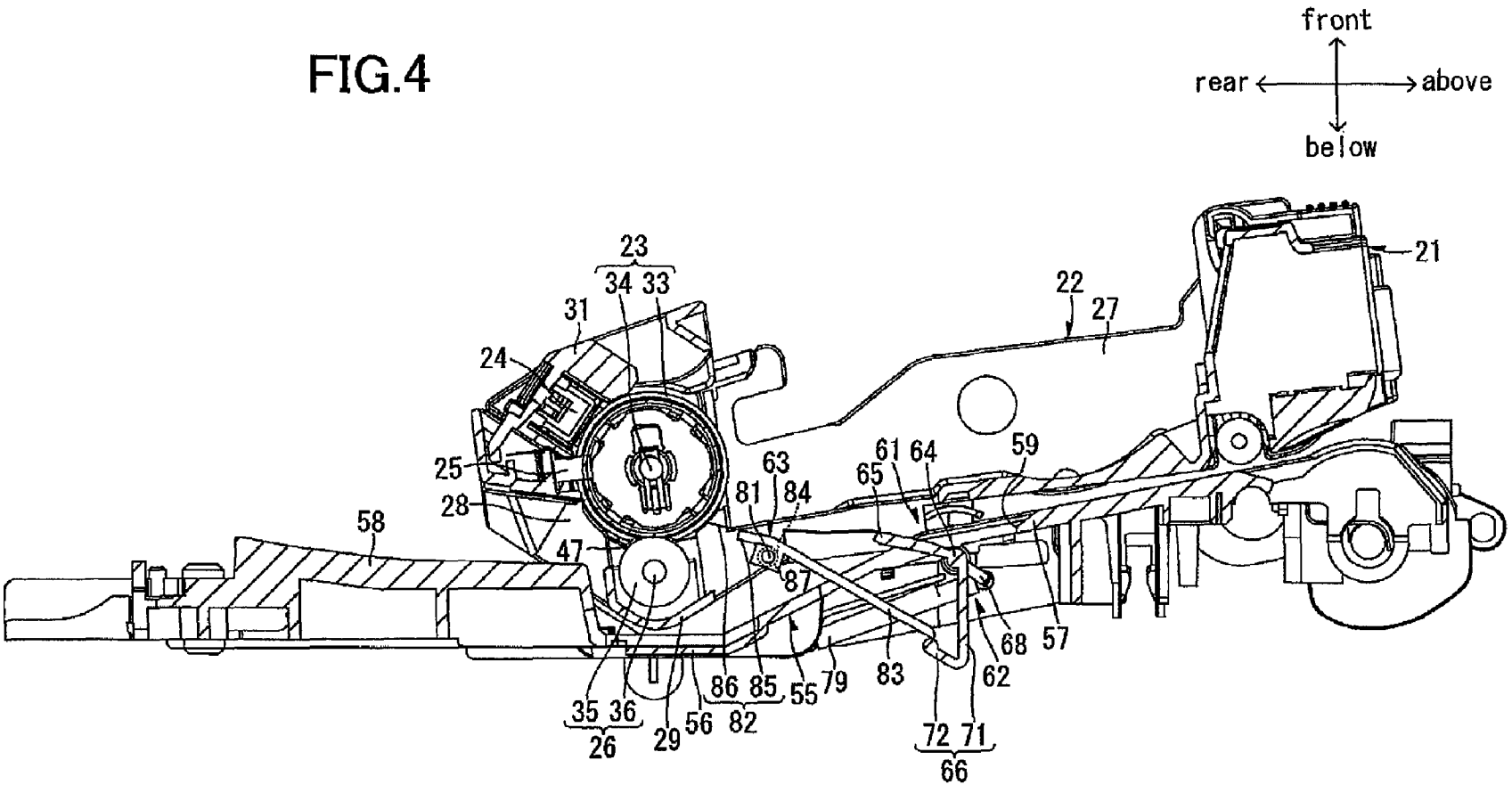
FIG. 4 is a side cross-sectional view of the drum cartridge and the paper-guiding plate (during the transfer operation)

The first pivoting member 62 remains in the passing position while the paper 3 passes over the paper contact part 65. While the first pivoting member 62 is in the passing position and the paper contact part 65 is angled rearward, a gap is formed above the paper contact part 65 for allowing passage of the paper 3, as shown in FIGS. 4 and 10. At this time, the first contact part 66 is arranged with the protruding rod 71 extending downward, and the sensor arm 67 is oriented with the light-interrupting piece 74 in the advanced position.

When in the advanced position, the light-interrupting piece 74 overlaps the detection position P in the optical path of the detection light, thereby preventing the light-receiving element 77 from receiving the detection light. The photosensor 75 inputs a light-interruption signal to a CPU (not shown) provided in the main casing 2 to indicate that the light-receiving element 77 is not receiving light. This light-interruption signal is inputted into the CPU while the paper 3 is in contact with the paper contact part 65.

Based on the timing that the light-interruption signal is inputted, the CPU controls the scanning unit 15 to begin scanning a laser beam at high speed. Accordingly, before the paper 3 comes into contact with the photosensitive drum 23, the scanning unit 15 forms an electrostatic latent image on the photosensitive drum 23 that is subsequently developed into a toner image.

In the meantime, since the second contact part 83 contacts the engaging piece 72 due to its own weight when the paper 3 presses against and rotates the paper contact part 65, rotating the first contact part 66 downward, the second contact part 83 pivots downward by its own weight following the engaging piece 72 of the light-emitting element 76. Since the second rotational shaft 81 rotates clockwise at this time, the second pivoting member 63 pivots from the separated position to the proximal position in association with the pivoting of the first pivoting member 62 as shown in FIG. 10.

In other words, the second pivoting member 63 is disposed in the proximal position while the paper 3 passes over the paper contact part 65. The proximal position denotes the orientation of the second pivoting member 63 when the rear edges of the film members 86 are disposed in proximity to the photosensitive drum 23. In other words, the film members 86 are oriented toward photosensitive drum 23 when the second pivoting member 63 is moved to the passing position. When the second pivoting member 63 is in the proximal position, the transfer guide part 82 protrudes rearward and upward from the second rotational shaft 81, as shown in FIGS. 4 and 10. At this time, the second contact part 83 slopes downward toward the front from the second rotational shaft 81 with the front end of the second contact part 83 contacting the top of the engaging piece 72.

Accordingly, after the leading edge of the paper 3 passes over the paper contact part 65, the film members 86 guides the paper 3 so that the leading edge of the paper 3 contacts the photosensitive drum 23 upstream of the transfer point. As a result, instead of a gap being formed between the paper 3 and photosensitive drum 23 on the upstream side of the transfer point, the paper 3 is conveyed to the transfer point in close contact with the photosensitive drum 23.

When the trailing edge of the paper 3 in the conveying direction (hereinafter simply referred to as the "trailing edge") subsequently passes over the paper contact part 65, the paper 3 no longer applies a force to the paper contact part 65. At this time, the urging force of the spring 79 rotates the first rotational shaft 64 clockwise so that the first pivoting member 62 pivots from the passing position to the non-passing position. Hence, the first pivoting member 62 once again returns to the non-passing position shown in FIG. 3.

Further, as the protruding rod 71 pivots upward together with the pivoting of the first pivoting member 62, the engaging piece 72 pivots upward while sliding rearward along the second contact part 83 of the second pivoting member 63. The force with which the engaging piece 72 presses against the second contact part 83 causes the second contact part 83 to pivot upward against its own weight. Since the second rotational shaft 81 rotates counterclockwise at this time, the second pivoting member 63 pivots from the proximal position to the separated position along with the pivoting of the first pivoting member 62. Hence, the second pivoting member 63 is again placed in the separated position shown in FIGS. 3 and 9.

When the second pivoting member 63 is in the separated position, the light-interrupting piece 74 is in the retracted position. Since the light-interrupting piece 74 is separated from the detection position P at this time, the light-receiving element 77 can receive the detection light. Hence, the photosensor 75 inputs a light-transmission signal to the CPU in the main casing 2 indicating that the light-receiving element 77 is receiving the detection light. The photosensor 75 inputs this light-transmission signal into the CPU as long as the paper 3 is not contacting the paper contact part 65.

Hence, the light-transmission signal is inputted into the CPU while the paper 3 is not contacting the paper contact part 65, and a light-interruption signal is inputted into the CPU when the light contacts the paper contact part 65.

When the second pivoting member 63 is disposed in the separated position, the film members 86 are separated from the photosensitive drum 23, with the rear edges of the film members 86 disposed near the transfer roller 26 side.

The image-forming device having the construction described above can obtain the following effects.

(1) When the paper 3 is conveyed by the registration rollers 13 toward the transfer position guiding mechanism 61, the leading edge of the paper 3 first contacts the paper contact part 65 and begins to pass over the paper contact part 65. When the paper 3 passes over the paper contact part 65, the first pivoting member 62 pivots about the first rotational shaft 64 into the passing position.

Next, the paper 3 passes over the film members 86. At this time, the second pivoting member 63 is disposed in the proximal position having pivoted about the second rotational shaft 81 together with the pivoting of the first pivoting member 62. Hence, the paper 3 is guided along the film members 86 while being conveyed to the photosensitive drum 23.

After the paper 3 has passed over the paper contact part 65, the first pivoting member 62 pivots about the first rotational shaft 64 and returns to the non-passing position, and the second pivoting member 63 pivots about the second rotational shaft 81 in association with the pivoting of the first pivoting member 62 and returns to the separated position separated from the photosensitive drum 23. When the trailing edge of the paper 3 has passed the paper contact part 65, the film members 86 are brought into the separated position, so that the second pivoting member 63 guides the recording medium without the paper 3 pressing the film members 86 downward. Hence, when the trailing edge of the paper 3 separates from the film members 86, it is prevented that the film members 86 generate abnormal noise.

Further, since the transfer position guiding mechanism 61 is configured to pivot the first pivoting member 62 and the second pivoting member 63 based only on passing or non-passing of the paper 3, there is no need to provide a complex structure for placing the guide member near and separating from the photosensitive drum, such as a sensor for detecting the leading edge of paper, motor, and CPU for moving the motor based on the signal from the sensor, and complex control, thereby reducing the number of required parts and simplifying the construction.

(2) Further, when the paper 3 contacts the paper contact part 65 extending into the paper-conveying path above the front guiding plate 57, the first rotational shaft 64 rotates about its axial center, pivoting the first contact part 66 into the passing position. As the first contact part 66 pivots, the second contact part 83 of the second pivoting member 63 slides along the engaging piece 72. At this time, the second rotational shaft 81 rotates about its axial center, pivoting the transfer guide part 82 and placing the second pivoting member 63 in the proximal position, with the film members 86 of the transfer guide part 82 in proximity to the photosensitive drum 23.

After the paper 3 passes over the paper contact part 65, removing contact between the paper 3 and paper contact part 65, the first rotational shaft 64 rotates about its axial center, pivoting the first contact part 66 and placing the first pivoting member 62 in the non-passing position.

As the first contact part 66 pivots, the second contact part 83 of the second pivoting member 63 slides along the engaging piece 72. At this time, the second rotational shaft 81 rotates about its axial center, pivoting the transfer guide part 82 and placing the second pivoting member 63 in the separated position in which the film members 86 of the transfer guide part 82 are separated from the photosensitive drum 23.

Hence, this construction can achieve reliable operations through simple formation of the first pivoting member 62 and the second pivoting member 63.

(3) When the paper 3 is conveyed through the transfer position guiding mechanism 61 toward the photosensitive drum 23, the paper 3 passes over the film members 86 on the transfer guide part 82. Therefore, the transfer position guiding mechanism 61 can reliably place the paper 3 in contact with the photosensitive drum 23.

(4) When the paper 3 does not contact the paper contact part 65, the second pivoting member 63 is disposed in the separated position by the weight of the second contact part 83, since the second contact part 83 always contacts the engaging piece 72 by its own weight in the transfer position guiding mechanism 61 described above. However, when the paper 3 contacts the paper contact part 65, the first pivoting member 62 is moved to the passing position. Hence, the engaging piece 72 is rotated downward so that the second pivoting member 63 moves to the proximal position allowing the second contact part 83 to pivot down. Accordingly, through a simple construction that eliminates the need for a coupling member for coupling the first contact part 66 and the second contact part 83, it is possible to pivot the second pivoting member 63 into the proximal position or the separated position in association with pivoting of the first pivoting member 62.

(5) In the transfer position guiding mechanism 61 described above, the second pivoting member 63 is formed to satisfy the equation $L1 \cdot F1 < L2 \cdot F2$, where L1 is the distance from the second rotational shaft 81 to the rear end of the guide-supporting part 85, F1 is the force that the weight of the transfer guide part 82 generates at the rear end of the guide-supporting part 85, L2 is the distance from the second rotational shaft 81 to the front end of the second contact part 83, and F2 is the force that the weight of the second contact part 83 generates at the front edge of the second contact part 83. Hence, the second pivoting member 63 can be reliably placed in contact with the first contact part 66 at all times through the weight of the second contact part 83.

(6) Further, after the paper 3 passes over the paper contact part 65, removing contact between the paper contact part 65 and paper 3, the first pivoting member 62 pivots about the axial center of the first rotational shaft 64 until the pivot-restricting protrusion 68 contacts the stopper 78, placing the first pivoting member 62 in the non-passing position. In this way, the first pivoting member 62 can be placed in a prescribed non-passing position while the second pivoting member 63 can be placed in prescribed separated position.

(7) In the transfer position guiding mechanism 61 described above, the light-interrupting piece 74 of the sensor arm 67 pivots between the passing position and non-passing position through rotation of the first rotational shaft 64 so that the light-interrupting piece 74 overlaps or separates from the detection position P. The photosensor 75 detects whether the light-interrupting piece 74 is in an overlapped state or separated state relative to the detection position P and inputs the detected state into the CPU as a light-interruption signal or a light-transmission signal. Accordingly, the CPU can detect the timing for beginning to write an image on the photosensitive drum 23 based on the timing of the inputted light-interruption signal. By controlling the scanning unit 15 to begin scanning a laser beam at a high speed based on the inputted timing of the light-interruption signal, the CPU can reliably transfer a toner image onto the paper 3. As a result, through the pivoting of the first pivoting member 62, this construction can simultaneously guide the paper 3 to the photosensitive drum 23 by the pivoting of the second pivoting member 63 and detect a timing to begin writing an image on the photosensitive drum 23.

(8) In the laser printer 1 of the preferred embodiment, the drum cartridge 21 is detachably mounted in the main casing 2. This construction can simplify operations for removing paper jams and for replacing the drum cartridge 21.

(9) Since the first pivoting member 62 is provided in the main casing 2 rather than in the drum cartridge 21, which is a consumable product, this construction reduces the cost of the drum cartridge 21. Further, if the first pivoting member 62 were provided in the drum cartridge 21, the first pivoting member 62 could be damaged when mounting or removing the drum cartridge 21. However, such damage can be avoided by providing the first pivoting member 62 in the main casing 2.

(10) On the other hand, the second pivoting member 63 is provided in the drum cartridge 21. This construction can improve the accuracy for placing the second pivoting member 63 in a proximal position and separated position relative to the photosensitive drum 23, making it possible to reliably transfer a toner image onto the paper 3.

Figure 11:
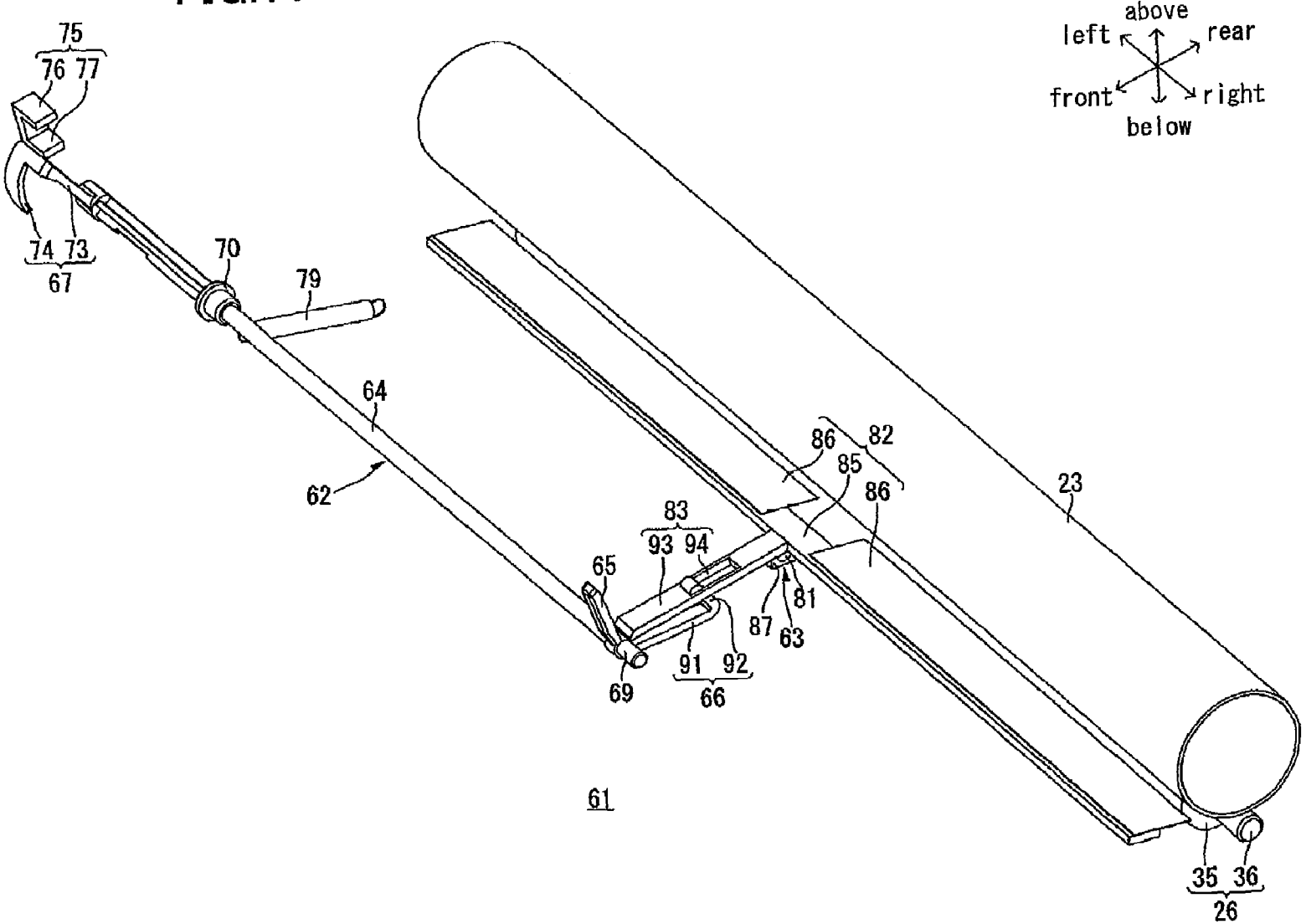
FIG. 11 is a side view illustrating another transfer point guiding mechanism (not during the transfer operation).

In the preferred embodiment described above, the second contact part 83 contacts the engaging piece 72 of the first contact part 66 by its own weight. However, the second contact part 83 may be slidably engaged with the first contact part 66, as shown in FIG. 11. In FIG. 11, like parts and components to those in the preferred embodiment described above are designated with the same reference numerals to avoid duplicating description.

As shown in FIG. 11, the first contact part 66 is formed substantially in the shape of the letter J in a side view, and is configured of a protruding rod 91 that protrudes along a straight line radially outward from the first rotational shaft 64, and an engaging piece 92 that is bent from the free end of the protruding rod 91 at a prescribed angle (45-135°, for example) toward the second contact part 83. The engaging piece 92 is shorter than the protruding rod 91. Both widthwise edges on the distal end of the engaging piece 92 protrude slightly outward in the width direction.

The second contact part 83 includes an engaging piece 93 that is substantially rectangular in a plan view. The engaging piece 93 extends in the front-to-rear direction and is slightly narrower than the drum-side slit 53. An elongated groove 94 is formed at a midpoint in the engaging piece 93 relative to the longitudinal direction and extends along the conveying direction of the paper 3 (the longitudinal direction) and receives the engaging piece 92 to slide therewithin.

The elongated groove 94 is formed with a front-to-rear length corresponding to the range in which the first pivoting member 62 pivots between the non-passing position and the passing position. The distal end of the engaging piece 92 penetrates and engages with the elongated groove 94. Through this construction, the engaging piece 92 is slidably fitted into the elongated groove 94 and is allowed to slide within the elongated groove 94 a distance corresponding to the range in which the first pivoting member 62 pivots between the non-passing position and the passing position.

When the paper 3 passes over the paper contact part 65 causing the first rotational shaft 64 to rotate about its axial center in the transfer position guiding mechanism 61, the engaging piece 92 of the first contact part 66 slides rearward relative to the elongated groove 94 of the second contact part 83. Hence, the second pivoting member 63 rotates about the axial center of the second rotational shaft 81 into the proximal position.

After the paper 3 passes over the paper contact part 65, the first rotational shaft 64 rotates about its axial center, sliding the engaging piece 92 of the first contact part 66 forward relative to the elongated groove 94 of the second contact part 83. At this time, the second pivoting member 63 rotates about the axial center of the second rotational shaft 81 back to the separated position.

In the transfer position guiding mechanism 61 shown in FIG. 11, the elongated groove 94 has a length in the front-to-rear direction corresponding to the range in which the first pivoting member 62 pivots between the non-passing position and the passing position. Hence, when the engaging piece 92 slides rearward in the elongated groove 94 and contacts the rear edge of the elongated groove 94, the second pivoting member 63 is disposed in the proximal position. When the engaging piece 92 slides forward in the elongated groove 94 and contacts the front edge of the elongated groove 94, the second pivoting member 63 is disposed in the separated position.

Through the simple construction of the preferred embodiment described above, the first pivoting member 62 can be reliably placed in the non-passing position or passing position and the second pivoting member 63 can be reliably placed in the proximal position or separated position through contact between the pivot-restricting protrusion 68 and stopper 78, rather than requiring special positioning.

Although the present invention has been described with respect to specific embodiments, it will be appreciated by one skilled in the art that a variety of changes may be made without departing from the scope of the invention. For example, although the embodiment has been described so that the first and second members 62 and 63 are pivotally movable about their own rotational shafts 64 and 81, these two members may be arranged to move differently, e.g., vertically. Further, in the above-described embodiment, the first pivoting member 62 has been described to have the paper contact part 65 and the first contact part 66 both protruding radially outward from angularly displaced positions on the same portion in the axial direction of the first rotational shaft 64. However, the paper contact part 65 and the first contact part 66 may be provided on different portions in the axial direction of the first rotational shaft 64 with the paper contact part 65 being disposed in the paper conveying path. The first contact part 66 may be disposed in a position offset from the paper conveying path.

What is claimed is:

1. An image-forming device comprising:

a casing;

an image-carrying member carrying a developer image;

a transfer member that is disposed in confrontation with the image-carrying member and transfers the developer image from the image-carrying member to a recording medium at a transfer point of contact with the image-carrying member;

a first guide member disposed in a predetermined position upstream of the transfer point in a conveying direction of the recording medium and selectively movable between a first position and a second position; and a second guide member disposed between the first guide member and the transfer point along the conveying direction of the recording medium and selectively movable between a third position and a fourth position farther from the image-carrying member than the third position, the second guide member being movable in association with the movement of the first guide member in such a manner that when the first guide member is disposed in the first position, the second guide member is disposed in the third position for guiding the recording medium received from the first guide member to move toward the image-carrying member.

2. The image-forming device according to claim 1, wherein the second guide member is movable in association with the movement of the first guide member in such a manner that when the first guide member is disposed in the second position, the second guide member is disposed in the fourth position.

3. The image-forming device according to claim 2, wherein the second guide member is selectively pivotally movable between the third position and the fourth position.

4. The image-forming device according to claim 1, wherein the first guide member is selectively pivotally movable between the first position and the second position.

5. The image-forming device according to claim 1, wherein the first guide member comprises:

a first shaft rotatably supported in the casing;

a first contact part protruding radially outward from the first shaft; and a first guiding part protruding radially outward from the first shaft, the first guiding part being brought into alignment with the conveying direction of the recording medium when the first guide member is moved to the first position, wherein the second guide member comprises:

a second shaft;

a second contact part that is provided on the second shaft and has a front edge portion, the second contact part being moved in interlocking relation with the first contact part; and a second guiding part that is provided on the second shaft and has a rear edge portion, the second guiding part guiding the recording medium to move toward the image-carrying member when the second guide member is moved to the third position.

6. The image-forming device according to claim 5, wherein the first guiding part is disposed in a direction orthogonal to the conveying direction of the recording medium when the first guide member is moved to the second position.

7. The image-forming device according to claim 5, wherein abutting the recording medium being conveyed against the first guiding part rotates the first guiding part to move the first guide member to the first position.

8. The image-forming device according to claim 5, wherein the second contact part is disposed above the first contact part and contacts the first contact part by a weight of the second guide member.

9. The image-forming device according to claim 8, wherein the second guide member is formed to satisfy an equation $L1 \cdot F1 < L2 \cdot F2$, where L1 is a distance between the second shaft and the rear edge of the second guiding part, F1 is a force generated by the weight of the second guide member between the second shaft and the rear edge of the second guiding part, L2 is a distance between the second shaft and the front edge of the second contact part, and F2 is a force generated by the weight of the second guide member between the second shaft and the front edge of the second contact part, the front edge portion of the second contact part is a portion disposed near the first guide member in the second contact part.

10. The image-forming device according to claim 5, wherein the first contact part comprises:

a protruding portion protruding radially outward from the first shaft; and an engaging portion protruding further from the protruding portion toward the second contact part and contacting the second contact part.

11. The image-forming device according to claim 5, wherein the second guide member comprises a flexible member extending from the second guiding part, the flexible member being oriented toward the transfer member when the second guide member is moved to the fourth position.

12. The image-forming device according to claim 11, wherein the second guide member guides the recording medium without the recording medium pressing the flexible member downward when the second guide member is disposed in the fourth position.

13. The image-forming device according to claim 5, further comprising a detection unit that detects operation of the first guide member.

14. The image-forming device according to claim 1, further comprising an urging member that urges the first guide member to be disposed in the second position.

15. The image-forming device according to claim 14, wherein the first guide member comprises a restricted portion, wherein the position member comprises:

a spring member urging the restricted portion so that the first guide member moves from the first position toward the second position, and a restricting member contacting the restricted portion and restricting the movement of the first guide member by the spring.

16. The image-forming device according to claim 1, wherein the first guide member comprises:

a first shaft rotatably supported in the casing;

a first guiding part protruding radially outward from the first shaft, the first guiding part being brought into alignment with the conveying direction of the recording medium when the first guide member is moved to the first position; and a first contact part comprising:

a protruding portion protruding radially outward from the first shaft; and an engaging portion protruding from the protruding portion, wherein the second guide member comprises:

a second shaft;

a second guiding part that is provided on the second shaft, the second guiding part guiding the recording medium to move toward the image-carrying member when the second guide member is moved to the third position; and a second contact part that is provided on the second shaft and has a groove, the second contact part being moved in interlocking relation with the first contact part, the groove extending in the conveying direction of the recording medium and receiving the engaging portion to slide therewithin.

17. The image-forming device according to claim 16, wherein the groove has a distance in the conveying direction of the recording medium corresponding to a range in which the first guide member moves between the first portion and the second portion.

18. The image-forming device according to claim 1, further comprising a process cartridge detachably mounted in the casing and accommodating the image-carrying member.

19. The image-forming device according to claim 18, wherein the first guide member is movably supported in the casing.

20. The image-forming device according to claim 18, wherein the second guide member is movably supported in the process cartridge.

21. A process cartridge detachably mounted in an image-forming device, the image-forming device comprising a casing and a first guide member disposed in the casing, the first guide member being selectively movable between a first position and a second position, the process cartridge comprising:

an image-carrying member carrying a developer image;

a transfer member that is disposed in confrontation with the image-carrying member and transfers the developer image from the image-carrying member to a recording medium at a transfer point of contact with the image-carrying member; and a second guide member disposed between the first guide member and the transfer point along the conveying direction of the recording medium and selectively movable between a third position and a fourth position farther from the image-carrying member than the third position, the second guide member being movable in association with the movement of the first guide member in such a manner that when the first guide member is disposed in the first position, the second guide member is disposed in the third position for guiding the recording medium received from the first guide member to move toward the image-carrying member.

22. The image-forming device according to claim 21, wherein the second guide member is selectively pivotally movable between the third position and the fourth position.

* * * * *